US010060676B2

(12) United States Patent
Hihn

(10) Patent No.: US 10,060,676 B2
(45) Date of Patent: Aug. 28, 2018

(54) DEVICE FOR CONTROLLING THE TEMPERATURE OF VEHICLE BODIES

(75) Inventor: Erwin Hihn, Walddorfhaeslach (DE)

(73) Assignee: EISENMANN SE, Boeblingen (DE)

( * ) Notice: Subject to any disclaimer, the term of this patent is extended or adjusted under 35 U.S.C. 154(b) by 414 days.

(21) Appl. No.: 13/984,583

(22) PCT Filed: Jan. 5, 2012

(86) PCT No.: PCT/EP2012/000032

§ 371 (c)(1),
(2), (4) Date: Aug. 9, 2013

(87) PCT Pub. No.: WO2012/110172

PCT Pub. Date: Aug. 23, 2012

(65) Prior Publication Data

US 2013/0312277 A1 Nov. 28, 2013

(30) Foreign Application Priority Data

Feb. 15, 2011 (DE) ..... 10 2011 011 261

(51) Int. Cl.
*F26B 19/00* (2006.01)
*F26B 21/00* (2006.01)
*F26B 15/14* (2006.01)

(52) U.S. Cl.
CPC ..... *F26B 21/004* (2013.01); *F26B 15/14* (2013.01); *F26B 2210/12* (2013.01)

(58) Field of Classification Search
CPC ..... F26B 19/00; F26B 25/00; F26B 25/06; F26B 21/004; F26B 15/14; F26B 2210/12; B05D 3/04; B05D 3/0406; B05D 3/0413
USPC ..... 34/666
See application file for complete search history.

(56) References Cited

U.S. PATENT DOCUMENTS 4,849,598 A 7/1989 Hiroyoshi et al.
5,018,966 A * 5/1991 Braun ..... F26B 25/00 432/2
5,205,364 A * 4/1993 Juergens ..... E21B 7/06 175/321
5,456,023 A * 10/1995 Farnan ..... F26B 21/004 239/71

(Continued)

FOREIGN PATENT DOCUMENTS

EP 0 268 691 6/1988
FR 2 029 314 10/1970

(Continued)

*Primary Examiner* — John McCormack
(74) *Attorney, Agent, or Firm* — Schroeder Intellectual Property Law Group, LLC

(57) ABSTRACT

A device for controlling the temperature of vehicle bodies, in particular for drying painted vehicle bodies, having a housing in which a temperature control tunnel and at least one pressure chamber separated therefrom by a wall are provided. In said wall there is a plurality of conventional nozzles via which temperature controlled air, which is introduced into the pressure chamber, is applied in particular in the upper region of the vehicle body. At least one nozzle device is provided which has a plurality of nozzle openings on the side thereof facing the vehicle body and at least roughly following the geometry of the lower region of the vehicle body at a distance from the vehicle body, which is smaller than the distance of the other nozzles arranged in the same wall.

15 Claims, 4 Drawing Sheets

(56) References Cited

U.S. PATENT DOCUMENTS

| | | | | |
|---|---|---|---|---|
| 6,062,850 | A * | 5/2000 | Ino | F26B 3/283 34/270 |
| 7,063,528 | B2 * | 6/2006 | Klobucar | F26B 21/10 34/266 |
| 7,200,953 | B2 * | 4/2007 | Sonner | F26B 21/004 34/225 |
| 8,393,895 | B2 | 3/2013 | Schwartz et al. | |
| 2009/0017408 | A1 * | 1/2009 | Pakkala | F26B 3/283 432/145 |

FOREIGN PATENT DOCUMENTS

| | | |
|---|---|---|
| GB | 615 953 | 1/1949 |
| GB | 964 765 | 7/1964 |
| JP | H04 358556 | 12/1992 |

* cited by examiner

DEVICE FOR CONTROLLING THE TEMPERATURE OF VEHICLE BODIES

RELATED APPLICATIONS

This application claims the filing benefit of International Patent Application No. PCT/EP2012/000032, filed Jan. 5, 2012, which claims the filing benefit of German Patent Application No. 10 2011 011 261.8 filed Feb. 15, 2011, the contents of both of which are incorporated herein by reference.

FIELD OF THE INVENTION

The invention relates to a device for controlling the temperature of vehicle bodies, in particular for drying coated vehicle bodies, having a) a housing;
b) a temperature control tunnel for receiving the vehicle bodies, which is accommodated in the housing;
c) at least one pressure chamber which is accommodated in the housing and separated from the temperature control tunnel by a wall;
d) a plurality of nozzles in the wall;
e) an air-temperature control device, which introduces temperature controlled air into the pressure chamber in such a way that it can flow into the temperature control tunnel through the nozzles and act on the vehicle body located there.

BACKGROUND OF THE INVENTION

The use of the term "temperature control" here in relation to a vehicle body means to bring a vehicle body to a specified temperature which it is not at initially. This can be an increase in temperature or a decrease in temperature. The term "temperature controlled air" refers to air which is at the temperature required to control the temperature of the vehicle body.

In the automotive industry, a frequent application involving the temperature control, namely heating, of vehicle bodies is the procedure of drying the coating of a vehicle body, be this a paint or an adhesive or the like. The following detailed description of the invention refers by way of example to a dryer of this type.

The term "dry" is used here to refer to all procedures in which the coating, in particular a paint, of the vehicle body can be hardened, either through the expulsion of solvents or through the cross-linking of the coating substance.

Known devices of the type mentioned at the outset which are constructed as dryers conventionally have a pressure chamber on both sides of the temperature control tunnel referred to in this case as a drying tunnel. The nozzles accommodated in the walls separating the pressure chambers from the drying tunnel are at different spacings from the regions of the vehicle body on which they are intended to act, which spacings are often not adapted to the drying requirement. However, vehicle bodies have different masses in different regions; in particular, the bottom-most region, the door sill region or the undercarriage, has a high mass. Accordingly, the heat capacities in the different vehicle body regions are also different and the times required to bring these regions to the temperature required for drying likewise differ. The residence time of the vehicle body to be dried in the dryer therefore has to be adapted to the longest time required to dry the region of the vehicle body which is the most awkward and has the greatest mass. Consequently, not only are the cycle times of the dryer increased, but those regions of the vehicle body which dry more quickly can become overheated. This can be particularly disadvantageous where different, even temperature-sensitive, materials are incorporated in the vehicle body and/or bonded joints have been used.

An object of the present invention is to construct a device of the type mentioned at the outset so that reduced cycle times can be achieved and unnecessary overheating or overcooling in particular regions of the vehicle body can be substantially prevented.

SUMMARY OF THE INVENTION

This object may be achieved according to the invention in that f) at least one nozzle device is provided, which has a nozzle body whereof the side facing the vehicle body is provided with a plurality of nozzle orifices and at least roughly follows the geometry of the lower region of the vehicle body, in particular the door sill region, at a spacing which is smaller than the spacing of the other nozzles arranged in the same wall from the vehicle body.

The invention recognises that, to control the temperature of the vehicle body evenly, the different regions have to be acted on by different intensities of temperature controlled air in order to account for the different local heat capacities. In particular, the lower region of the vehicle body, the door sill region or the undercarriage, requires a particular application of temperature controlled air. According to the invention, this takes place using a special nozzle device which is moved such that one side is particularly close to this lower region of the vehicle body and whereof the geometry is also adapted to the geometry of the lower vehicle body region to enable the smallest possible spacings to be observed. This enables the high-mass lower region of the vehicle body to be brought to the desired temperature in approximately the same time as the lower-mass regions higher up. As a whole, the temperature control of the vehicle body takes place more quickly and without impermissible high or low local temperatures which could damage the materials of the vehicle body. The invention is moreover associated with a reduction in energy when used as a dryer since it is possible to work with relatively low temperatures of the hot air.

The nozzle device advantageously reaches around the vehicle body at the bottom, which means that it is not only guided along the lateral surface of the lower vehicle body region but is shaped around the lower region at the bottom and reaches a certain distance underneath the vehicle body. Undercuts in the geometry of the nozzle body are also possible here.

In a particularly preferred embodiment of the invention, the nozzle device is detachably mounted on at least one orifice in the wall between the pressure chambers and the temperature control tunnel. This enables it to be removed quickly as required. This is important because it reaches relatively far into the temperature control tunnel and could therefore be in the way during certain operations such as cleaning and maintenance work, also on the transport system, outside of the actual temperature control operation.

It is furthermore advantageous if the at least one orifice on which the nozzle device is mounted is constructed in the same manner as the orifices in which the other, standard nozzles are mounted in the same wall. This means that the nozzle device can, for example, be retrofitted in that one or more of the standard nozzles in the lower region of the wall between the pressure chamber and the temperature control tunnel in a conventional device is removed and the nozzle device according to the invention is instead mounted on this or these orifices. Conversely, it goes without saying that it is also readily possible to convert a device constructed according to the invention back into a conventional device.

The nozzle device can also be pivotally mounted on the wall and, in a pivoted position, free a relatively large opening between the pressure chamber and the temperature control tunnel. In particular, this then allows cleaning work outside of the actual temperature control operation.

The spacing between that side of the nozzle device which faces the vehicle body and the vehicle body is advantageously approximately 20 cm. At this spacing, an effective and rapid temperature control result is achieved for conventional materials without damaging these materials. For nozzles which are directed specifically against the floor of the vehicle body, the spacing can also be smaller, in particular approximately 10 cm.

The nozzle body can be replaceable. This enables the device to be easily adapted to different vehicle bodies with different geometries in the lower region.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

Exemplary embodiments of the invention are explained in more detail below with reference to the drawing, which shows.

DETAILED DESCRIPTION OF THE PRESENT INVENTION

Figure 1:
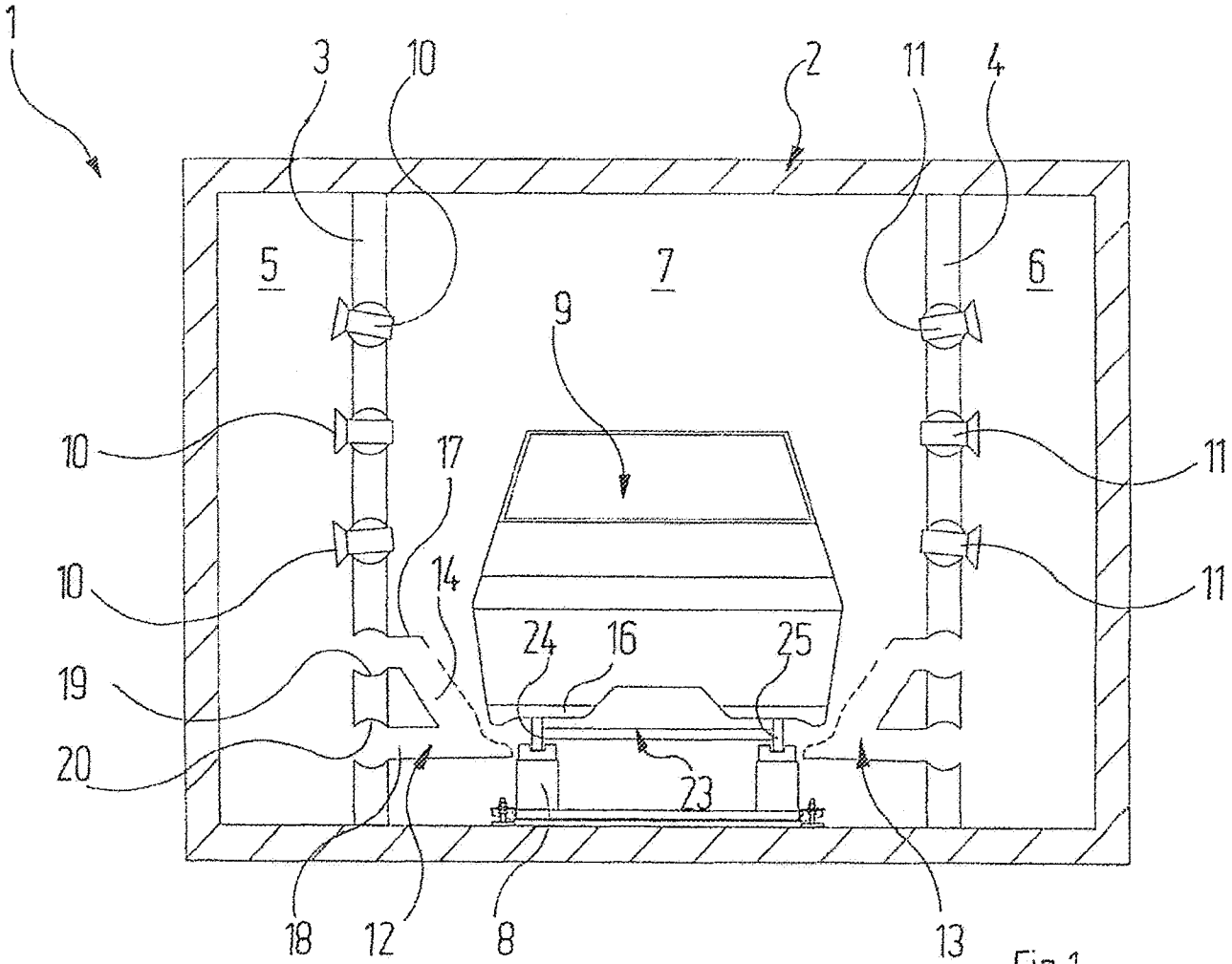
FIG. 1 a vertical section through a dryer for vehicle bodies.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Figure 2:
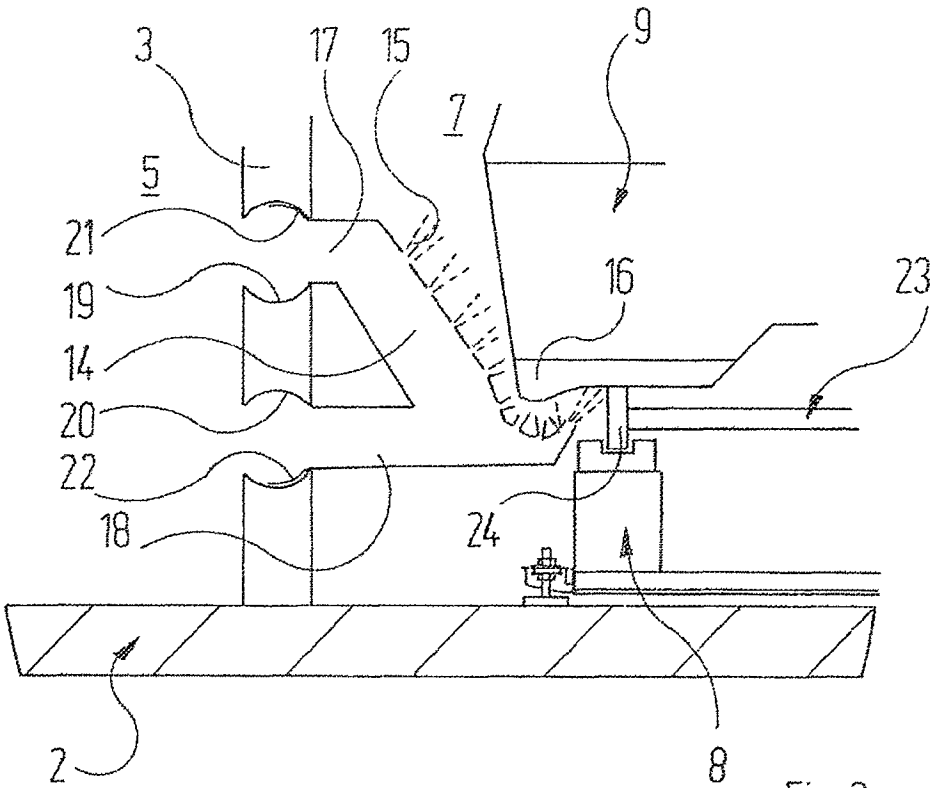
FIG. 2 a detail from FIG. 1 on an enlarged scale.

Reference is firstly made to FIGS. 1 and 2. These show a dryer, denoted as a whole by the reference numeral 1, which is illustrated schematically and serves as an example of a temperature control device. It comprises, in known manner, a housing 2 whereof the interior is divided into two lateral pressure chambers 5, 6 and a temperature control tunnel 7, located in the centre and serving as a drying tunnel, by two walls 3, 4 extending in the longitudinal direction. Extending through the drying tunnel 7 is a conveyor system 8 which conveys the freshly coated vehicle bodies 9 to be dried through the drying tunnel 7 perpendicularly to the plane of the drawing. An inlet lock and an outlet lock, which are not shown and do not need describing in greater detail, are located in known manner at the inlet and the outlet of the drying tunnel 7.

A plurality of nozzles 10, 11 which connect the pressure chambers 5, 6 to the drying tunnel 7 are provided in the walls 3, 4. These nozzles 10, 11 are of a conventional construction and do not need describing in greater detail. They are referred to here as "standard" nozzles. It is sufficient to know that the orientation of their axis within the walls 3, 4 can be adjusted as required.

In the lower region of the walls 3, 4, more complex nozzle devices 12, 13 are arranged which likewise connect the pressure chambers 5, 6 to the drying tunnel 7 and whereof the construction will now be explained in more detail with reference to the nozzle device 12. The construction of the nozzle device 13 is essentially the same.

As shown in particular in FIG. 2, the nozzle device 12 has a central nozzle body 14 which is positioned at an angle to both the vertical and the horizontal and in which a plurality of individual nozzle orifices 15 are provided in the side facing the vehicle body 9. This side of the nozzle body 14 is at least approximately adapted in terms of its shape to the door sill region 16 of the vehicle body 9 and reaches around this door sill region 16 at the bottom. It is even possible to see an undercut here. The two opposite ends of the nozzle body 14 are connected by connecting channels 17, 18, which extend approximately horizontally in the installed position, to orifices 19, 20 in the wall 3 which serve to receive standard nozzles 10 in conventional dryers and have spherical lateral surfaces for this purpose. The ends of the connecting channels 17, 18 are each provided with spherical clamping plates 21, 22. This enables the entire nozzle device 12 to be fixedly clamped by inserting the clamping plates 21, 22 into the orifices 19, 20 in the wall 3.

As they are transported through the drying tunnel 7 by means of the conveyor system 8, the vehicle bodies 9 are located on skids 23, as is known per se, these having two runners 24, 25 extending parallel to the conveying direction. The transport system 8 starts to move the vehicle body connected to the skid 22 continuously on these runners 24, 25. A shielding plate 40 protects these from the direct application of hot air.

The two pressure chambers 5, 6 are connected in known manner to a source of hot pressurised air; suction orifices (not illustrated) by way of which the air can be discharged from the drying tunnel 7 again are generally located in the lower region of the drying tunnel. The dryer 1 is generally operated in recirculating-air mode; this means that the air extracted from the drying tunnel 7 is cleaned and then reheated and returned to the pressure chambers 5, 6 in a cycle with the aid of a ventilator.

When the dryer 1 is in operation, the standard nozzles 10, 11 apply hot air to the vehicle bodies 9 in the lateral and upper region either during their continuous movement or whilst they are stationary. The relatively low-mass lateral and upper regions of the vehicle body 9 are thus dried.

In the lower region of the vehicle body 9, in particular in the door sill region 16, where the masses and therefore also the heat capacities of the vehicle body 9 are relatively high, the nozzle devices 12, 13 bring the hot air coming from the pressure chambers 5, 6 relatively close to the surface of the vehicle body 9, in particular the door sill region 16, which is thus subjected to a particularly high intensity of hot air. A favourable spacing is approximately 20 cm, for the nozzle orifices 15 acting on the floor of the vehicle body even a mere 10 cm. As a result of the proximity of the nozzle orifices 15 of the nozzle devices 12, 13 to the corresponding surface regions of the vehicle bodies 9, the high-mass under-region of the vehicle body 9 is also adequately heated in a drying time which corresponds approximately to the time in which the standard nozzles 10, 11 are able to dry the upper region of the vehicle body 9. It is thus possible to reduce the cycle times for drying the vehicle body 9 and prevent overheating which cannot be ruled out in the upper region of the vehicle body 9 in the case of conventional dryers.

Figure 3:
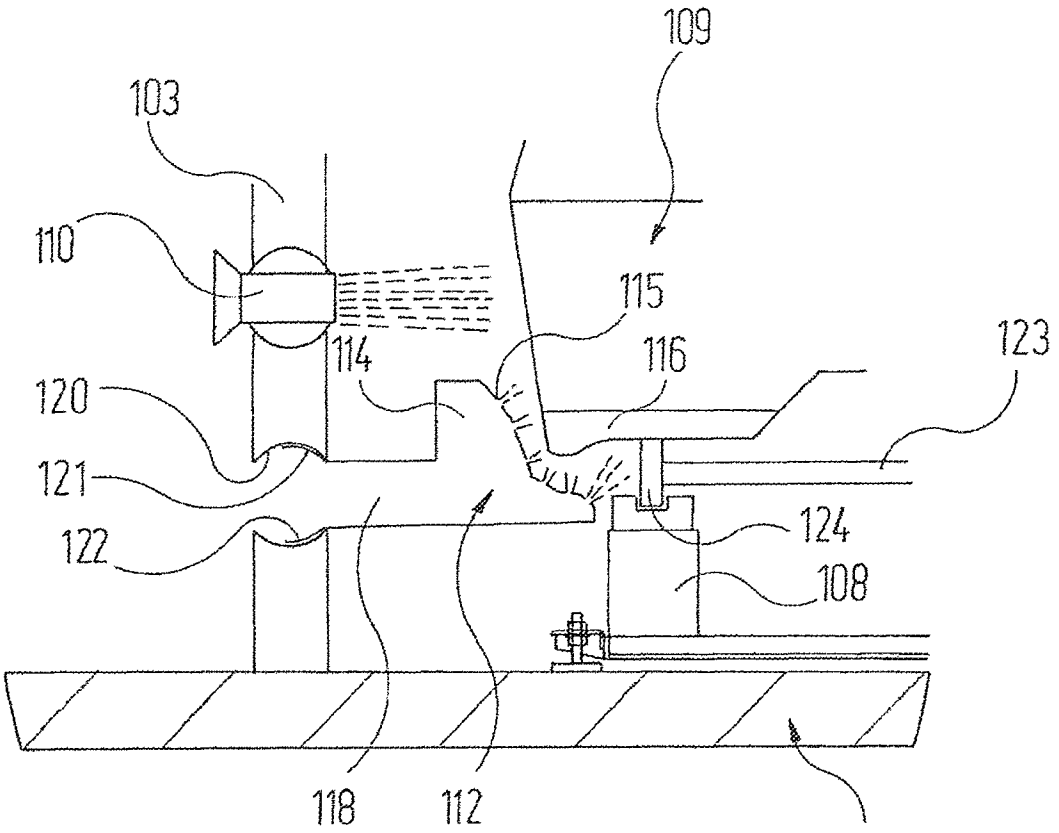
FIG. 3 a detail, similar to FIG. 2, through a modified embodiment of a dryer.

FIG. 3 shows a detail, corresponding to FIG. 2, of a variant of a dryer 101 in a sectional view. Corresponding parts in FIG. 3 are denoted by the same reference numerals as in FIG. 2, but increased by 100. FIG. 3 shows the longitudinal wall 103, which separates the pressure chamber 105 from the drying tunnel 107, and a standard nozzle 110. This nozzle 110 is located in an orifice 119 of the wall 103 which served in the exemplary embodiment of FIG. 2 to receive the one connecting channel 17 of the nozzle device 12. In the exemplary embodiment of FIG. 3, the nozzle device 112 only has one connecting channel 118 at the ends of which two clamping plates 121, 122 are located, which are fixedly clamped in the orifice 120 in the wall 103. The nozzle body 114 of the nozzle device 112 also has a plurality of nozzle orifices 115 in the side facing the vehicle body 109; this side is adapted in terms of its contour to the contour of the door sill region 116 of the vehicle body 109 to be dried. The embodiment of the nozzle device 112 shown in FIG. 3 is somewhat cheaper than that of FIG. 2 and is mainly used where the hot air requirement for drying the door sill region 116 of the vehicle body 109 is not so high.

Figure 4:
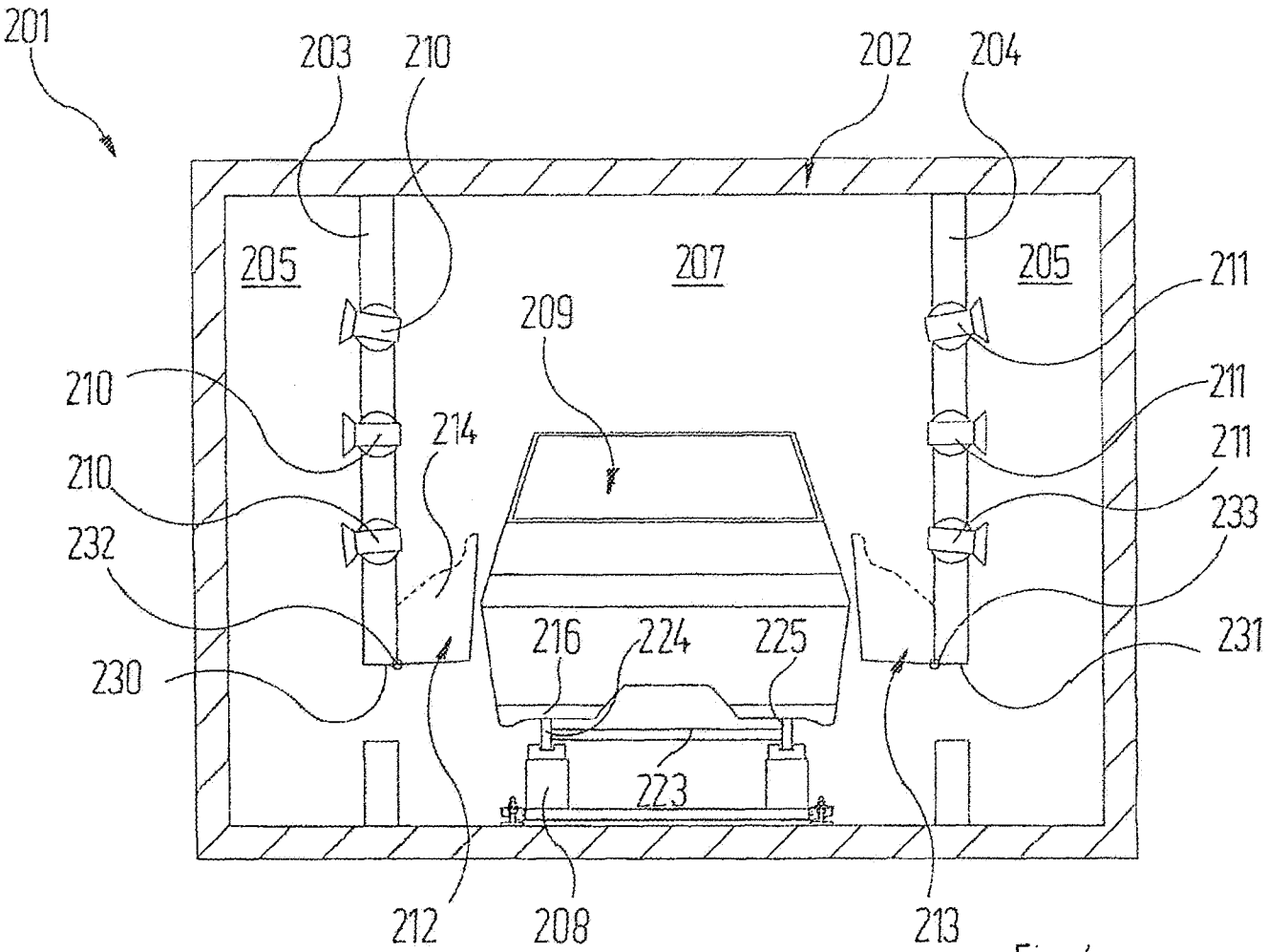
FIG. 4 a section, similar to FIG. 1, through a further exemplary embodiment of a dryer according to the invention.

FIG. 4 shows a further exemplary embodiment of a dryer 201 which likewise substantially corresponds in terms of its construction and its function to that of FIG. 1. Corresponding components of the dryer 201 in FIG. 4 are denoted by the same reference numerals as in FIG. 1, but increased by 200. The components which remain unaltered are not described again. The sole difference between the exemplary embodiments of FIGS. 1 and 4 is that the nozzle devices 212, 213 in FIG. 4 are not fixedly clamped to the corresponding walls 203 and 204 and are also not connected to those orifices in the walls 203, 204 which could alternatively serve to receive standard nozzles 210, 211. Instead, the walls 203, 204 have relatively extensive openings 230, 231 in the lower region.

The nozzle devices 212, 213 which serve to act on the lower region 216 of the vehicle body 209 with hot air are coupled to the wall 203 and 204 by way of pivot axes 232, 233. The nozzle devices 212, 213 are in the form of hollow boxes which in turn have a plurality of nozzle orifices 215 on one side, with this side being adapted to the contour of the lower region 216 of the vehicle body 209. The opposite side of the nozzle devices 212, 213 is open.

In FIG. 4, the nozzle devices 212, 213 are pivoted upwards about the respective pivot axes 232, 233 into a non-functioning position in which the openings 230, 231 in the walls 203, 204 are completely clear. This enables cleaning and maintenance work outside of the actual drying operation to be carried out easily. However, for actually drying the vehicle body 209, the nozzle devices 212, 213 are pivoted downwards so that their open side, which extends horizontally in FIG. 4, covers the openings 230, 231 in the walls 203, 204 and, as in the exemplary embodiment of FIG. 1, the hot air from the pressure chambers 205, 206 can be specifically directed against the lower sections 216 of the vehicle body 209 in the drying tunnel 207 by way of the nozzle devices 212, 213.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. A device for controlling the temperature of vehicle bodies comprising:

a housing;

a temperature control tunnel for receiving vehicle bodies, the temperature control tunnel being formed within the housing;

at least one pressure chamber formed within the housing and separated from the temperature control tunnel by at least one wall;

a plurality of nozzles provided in orifices formed in the at least one wall, the plurality of nozzles including at least one nozzle having a first configuration and at least one nozzle having a second configuration, the second configuration being different from the first configuration, wherein the at least one nozzle having the second configuration includes a nozzle body having a plurality of nozzle orifices, the nozzle body extending laterally beyond a surface of the at least one wall defining the temperature control tunnel into an interior of the temperature control tunnel and being configured to follow a geometry of a lower region of a vehicle body positioned in the temperature control tunnel.

2. The device according to claim 1, wherein the at least one nozzle having the second configuration includes a portion which anchors the at least one nozzle having the second configuration within the orifices formed in the at least one wall.

3. The device according to claim 1, wherein the plurality of nozzle orifices formed in the nozzle body of the at least one nozzle having the second configuration include nozzle orifices aimed in at least two different directions.

4. The device according to claim 2, wherein the orifices to which the portion which anchors the at least one nozzle having the second configuration are configured to receive at least one nozzle having the first configuration.

5. A device for controlling the temperature of vehicle bodies comprising:

a housing;

a temperature control tunnel for receiving vehicle bodies, the temperature control tunnel being formed within the housing;

at least one pressure chamber formed within the housing and separated from the temperature control tunnel by at least one wall, the at least one wall having a plurality of orifices;

a plurality of nozzles provided in the orifices formed in the at least one wall, the plurality of nozzles including at least one nozzle having a first configuration and at least one nozzle having a second configuration, the second configuration being different from the first configuration, wherein the at least one nozzle having the second configuration includes a nozzle body having a plurality of nozzle orifices, the nozzle body extending laterally beyond a surface of the at least one wall defining the temperature control tunnel into an interior of the temperature control tunnel and being configured to follow a geometry of a lower region of a vehicle body positioned in the temperature control tunnel, and each orifice formed in the at least one wall is configured to be capable of receive a nozzle having the first configuration.

6. A device for controlling the temperature of vehicle bodies comprising:

a housing;

a temperature control tunnel for receiving vehicle bodies, which is accommodated in the housing;

at least one pressure chamber which is accommodated in the housing and separated from the temperature control tunnel by at least one wall;

a plurality of nozzles provided in the at least one wall, the plurality of nozzles including at least one nozzle having a first configuration and at least one nozzle having a second configuration;

an air-temperature control device, which introduces temperature controlled air into the pressure chamber in such a way that the temperature controlled air flows into the temperature control tunnel through the plurality of nozzles and acts on a vehicle body located in the temperature control tunnel;

wherein the at least one nozzle having the second configuration includes a nozzle body whereof a side facing a vehicle body in the temperature control tunnel is provided with a plurality of nozzle orifices and at least roughly follows a geometry of a lower region of a vehicle body at a spacing which is less than a spacing from the vehicle body of the at least one nozzle having the first configuration.

7. A device according to claim 6, wherein the at least one nozzle having the second configuration reaches around a vehicle body at a bottom.

8. A device according to claim 6, wherein the at least one nozzle having the second configuration is detachably mounted on at least one orifice in the at least one wall between the at least one pressure chamber and the temperature control tunnel.

9. A device according to claim 8, wherein the at least one orifice on which the at least one nozzle having the second configuration is mounted is constructed in the same manner as orifices in which the at least one nozzle having the first configuration is mounted in the at least one wall.

10. A device according to claim 6, wherein the at least one nozzle having the second configuration is pivotally mounted on the at least one wall.

11. A device according to claim 6, wherein a spacing between the side of the at least one nozzle having the second configuration which faces the vehicle body and the vehicle body is approximately 20 cm.

12. A device according to claim 6, wherein the nozzle body is replaceable.

13. The device according to claim 6, wherein the at least one nozzle having the second configuration extends laterally beyond a surface of the wall defining the temperature control tunnel and into the temperature control tunnel.

14. The device according to claim 6, wherein the at least one nozzle having the second configuration includes a portion which anchors the at least one nozzle having the second configuration within the at least one wall.

15. The device according to claim 6, wherein the plurality of nozzle orifices formed in the nozzle body of the at least one nozzle having the second configuration include at least two nozzle orifices aimed in at least two different directions.

* * * * *